US009761361B2

(12) United States Patent
Okabe et al.

(10) Patent No.: US 9,761,361 B2
(45) Date of Patent: Sep. 12, 2017

(54) GRAIN-ORIENTED ELECTRICAL STEEL SHEET

(71) Applicant: JFE Steel Corporation, Tokyo (JP)

(72) Inventors: Seiji Okabe, Tokyo (JP); Shigehiro Takajo, Tokyo (JP); Takashi Kawano, Tokyo (JP)

(73) Assignee: JFE Steel Corporation (JP)

( * ) Notice: Subject to any disclaimer, the term of this patent is extended or adjusted under 35 U.S.C. 154(b) by 530 days.

(21) Appl. No.: 14/376,916

(22) PCT Filed: Feb. 8, 2013

(86) PCT No.: PCT/JP2013/000701
§ 371 (c)(1),
(2) Date: Aug. 6, 2014

(87) PCT Pub. No.: WO2013/118512
PCT Pub. Date: Aug. 15, 2013

(65) Prior Publication Data
US 2015/0013849 A1 Jan. 15, 2015

(30) Foreign Application Priority Data
Feb. 8, 2012 (JP) ..... 2012-025238

(51) Int. Cl.
*H01F 1/16* (2006.01)
*C21D 8/12* (2006.01)
(Continued)

(52) U.S. Cl.
CPC ..... *H01F 1/16* (2013.01); *C21D 1/38* (2013.01); *C21D 8/12* (2013.01); *C21D 8/125* (2013.01);
(Continued)

(58) Field of Classification Search
CPC ..... C22C 38/02; C22C 38/04; H01F 1/16
See application file for complete search history.

(56) References Cited

U.S. PATENT DOCUMENTS 4,363,677 A 12/1982 Ichiyama et al.
2009/0114316 A1* 5/2009 Sakai ..... B23K 26/0626 148/100
2013/0206283 A1* 8/2013 Inoue ..... C21D 1/38 148/108

FOREIGN PATENT DOCUMENTS

EP 0 611 829 8/1994
EP 0 870 843 10/1998
(Continued)

OTHER PUBLICATIONS

Chinese Office Action dated Aug. 19, 2015 of corresponding Chinese Application No. 201380008689.6 along with an English translation.
(Continued)

*Primary Examiner* — Roy King
*Assistant Examiner* — Jophy S Koshy
(74) *Attorney, Agent, or Firm* — DLA Piper LLP (US)

(57) ABSTRACT

A grain-oriented electrical steel sheet produces reduced noise when worked into a transformer, by setting length d of each plastic strain region in the widthwise direction of the steel sheet to 0.05 mm or more and 0.4 mm or less, and a ratio ($\Sigma d/\Sigma w$) of a total $\Sigma d$ of the length d to a total $\Sigma w$ of application interval w of each of the above plastic strain regions to 0.2 or more and 0.6 or less.

4 Claims, 3 Drawing Sheets

(51) Int. Cl.

| | |
|---|---|
| ***C22C 38/00*** | (2006.01) |
| ***C22C 38/60*** | (2006.01) |
| ***C21D 1/38*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |

(52) U.S. Cl.

CPC ..... *C22C 38/00* (2013.01); *C22C 38/002* (2013.01); *C22C 38/008* (2013.01); *C22C 38/02* (2013.01); *C22C 38/04* (2013.01); *C22C 38/08* (2013.01); *C22C 38/12* (2013.01); *C22C 38/16* (2013.01); *C22C 38/60* (2013.01); *C21D 2201/05* (2013.01)

(56) References Cited

FOREIGN PATENT DOCUMENTS

| | | | | |
|---|---|---|---|---|
| EP | 2 006 397 | | 12/2008 | |
| EP | 2 799 566 | | 11/2014 | |
| JP | 56-123325 | A | 9/1981 | |
| JP | 57-192223 | A | 11/1982 | |
| JP | 63-227720 | A | 9/1988 | |
| JP | 1-191744 | A | 8/1989 | |
| JP | 2-277780 | A | 11/1990 | |
| JP | 3-13293 | B2 | 2/1991 | |
| JP | 3-260020 | A | 11/1991 | |
| JP | 7-65106 | B2 | 7/1995 | |
| JP | 2003-034822 | A | 2/2003 | |
| JP | WO 2007116893 | A1 * | 10/2007 | ..... B23K 26/0626 |
| JP | 2012-036445 | A | 2/2012 | |
| JP | 2012-036450 | A | 2/2012 | |
| JP | WO 2012017693 | A1 * | 2/2012 | ..... C21D 1/38 |
| KR | 1994-0008459 | | 9/1994 | |
| WO | 2012/001965 | | 1/2012 | |

OTHER PUBLICATIONS

Supplementary European Search Report dated Oct. 12, 2015 of corresponding European Application No. 13746080.4.

Notice of Grounds for Rejection dated Oct. 20, 2015 of corresponding Korean Application No. 2014-7024613 along with an English translation.

Japanese Office Action dated Jul. 7, 2015 of corresponding Japanese Application No. 2012-025238 with an English translation.

* cited by examiner

GRAIN-ORIENTED ELECTRICAL STEEL SHEET

TECHNICAL FIELD

This disclosure relates to a grain-oriented electrical steel sheet utilized for an iron core material of a transformer or the like.

BACKGROUND

In recent years, energy use has become more and more efficient, and demands are increasingly being made, mainly from transformer manufacturers and the like, for an electrical steel sheet with high flux density and low iron loss.

Flux density can be improved by according crystal orientations of the electrical steel sheet with the Goss orientation.

With regards to iron loss reduction, measures have been devised from the perspectives of increasing purity of the material, high orientation, reduced sheet thickness, addition of Si and Al, magnetic domain refining, and the like. However, iron loss properties generally tend to worsen as the flux density is higher. The reason is that when the crystal orientations are aligned, the magnetostatic energy decreases and, therefore, the magnetic domain width widens, causing eddy current loss to rise.

One solution to this problem is to reduce eddy current loss. Specific methods include a method of applying magnetic domain refining by applying thermal strain to the surface of a steel sheet with a method such as a laser or electron beam. Both methods are known to exhibit an extremely high improving effect in iron loss by irradiation.

For example, JPH7-65106B2 discloses a method of manufacturing an electrical steel sheet having iron loss $W_{17/50}$ of below 0.8 W/kg due to electron beam irradiation.

Furthermore, JPH3-13293B2 discloses a method of reducing iron loss by applying laser irradiation to an electrical steel sheet.

However, although grain-oriented electrical steel sheets subjected to magnetic domain refining by irradiating laser or electron beam may exhibit good characteristics as a material, there are cases where good characteristics cannot be obtained when manufacturing a transformer using the same grain-oriented electrical steel sheet. Specifically, the problem is that the noise of the transformer increases. In other words, even if iron loss, flux density, magnetostriction and the like measured in the state of a single sheet material are the same, some conditions produce transformers with a loud noise and some conditions produce transformers with a small noise, depending on the pattern of applying thermal strain.

It could therefore be helpful to provide a grain-oriented electrical steel sheet capable of effectively reducing the noise caused by the grain-oriented electrical steel sheet when worked into a transformer.

SUMMARY

We prepared transformers of many grain-oriented electrical steel sheets subjected to magnetic domain refining treatment with different patterns of applying thermal strain, and conducted a systematic investigation. As a result, we discovered that the increase in noise of the transformer is caused by the shape of the region where plastic strain is generated when thermal strain is applied in a strong degree.

Additionally, the pattern of applying strain can be divided into 2 types, namely, a continuous pattern in the widthwise direction of the steel sheet such as continuous laser irradiation, and an intermittent pattern in the widthwise direction of the steel sheet such as pulse laser irradiation. We discovered that it is possible to achieve both iron loss reduction and noise suppression of the transformer particularly when the area of the plastic strain regions at the time of application of intermittent strain regions, and the ratio that the area of the plastic strain regions occupies in the widthwise direction of the steel sheet, are in a certain range.

We thus provide:

1. A grain-oriented electrical steel sheet to which plastic strain regions are applied in a dot-sequence manner in widthwise direction of the steel sheet by magnetic domain refining treatment, wherein a length d of each of the plastic strain regions in the widthwise direction of the steel sheet is 0.05 mm or more and 0.4 mm or less, and a ratio ($\Sigma d/\Sigma w$) of a total $\Sigma d$ of the length d to a total $\Sigma w$ of an application interval w of each of the plastic strain regions is 0.2 or more and 0.6 or less.
2. The grain-oriented electrical steel sheet according to the aspect 1, wherein a ratio (d/w) of the length d of each of the plastic strain regions to the application interval w corresponding to the length d of each of the plastic strain regions is 0.2 or more and 0.6 or less.
3. The grain-oriented electrical steel sheet according to the aspect 1 or 2, wherein the plastic strain regions are formed by electron beam irradiation.

It is possible to suppress the increase in noise of a transformer and at the same time reduce iron loss of the transformer, when performing magnetic domain refining of the grain-oriented electrical steel sheet. Therefore, energy efficiency of a transformer is enhanced, and our steel sheets and methods are extremely useful in the industry.

BRIEF DESCRIPTION OF THE DRAWINGS

Our steel sheets and methods will be further described below with reference to the accompanying drawings.

DETAILED DESCRIPTION

The following describes our steel sheets and methods in detail.

Strain regions are applied to a grain-oriented electrical steel sheet from one end to the other in the width direction of the steel sheet in a linear or curved manner, or in a direction orthogonal to the rolling direction in a dot-sequence manner. Strain region(s) generated in such way are hereinafter referred to as a "thermal strain application line." This thermal strain application line is periodically applied in rolling direction, to generate a magnetic domain pattern.

Each of the plural thermal strain application lines periodically applied in rolling direction is applied in a direction orthogonal to the rolling direction (a preferable range is ±30° to the direction orthogonal to the rolling direction), and magnetic domain refining treatment is performed in a desirable area of the steel sheet.

To perform application of strain regions, heat/light/particle beam irradiation such as laser irradiation, electron beam irradiation, plasma flame irradiation where local and rapid heating is possible, can be used. From the perspective of controllability of the shape and size of strain regions, laser and electron beams which enable controlling the beam diameter to be small, are preferred.

By applying laser irradiation or electron beam irradiation, the surface of a steel sheet is rapidly heated and thermal expansion is caused. However, since the heating time is extremely short, the region which is heated to a high temperature is limited to a local area. The local area is restrained by a surrounding non-heated region and, therefore, the location where thermal strain is applied receives a large compressive stress, and causes generation of a plastic strain.

Figure 1:
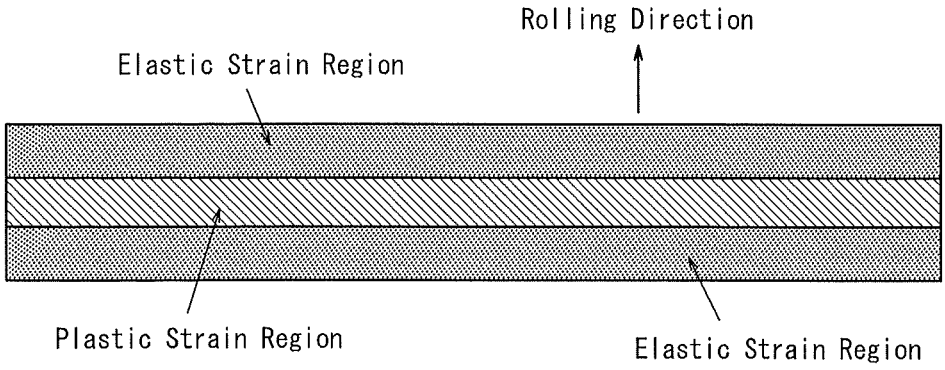
FIG. 1 is a schematic diagram illustrating an example of a plastic strain region and elastic strain regions.
Figure 2:
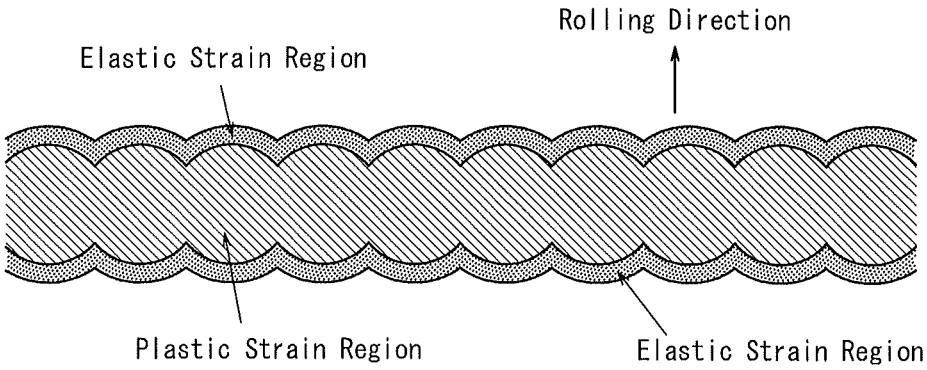
FIG. 2 is a schematic diagram illustrating another example of a plastic strain region and elastic strain regions.

This plastic strain remains after being cooled to room temperature and forms an elastic stress field in the surrounding area. FIG. 1 schematically illustrates a thermal strain application line when a laser or an electron beam continuously moves over a steel sheet. As illustrated in FIG. 1, generation of a thermal strain application line forms a plastic strain region and an elastic strain area in a belt like shape. On the other hand, when a thermal strain is applied in a pulse, the above thermal strain application line takes the forms illustrated in FIG. 2, 3, or 4, depending on the size of the strain regions.

In other words, depending on irradiation conditions of laser or electron beam, different strain distributions as illustrated in FIGS. 1 to 4 are formed.

From the perspective of iron loss, the steel sheets of the above FIGS. 1 to 4 exhibit equal iron loss reduction effects obtained by magnetic domain refining. In other words, even if the iron loss reduction effects obtained by magnetic domain refining are equal, steel sheets with different strain distributions are formed.

The range of these plastic strain regions can be obtained by analyzing data of X-ray diffraction measured from the surface of the steel sheet. In other words, utilizing the fact that the half value width of X-ray diffraction is increased by non-uniform strain in a plastic strain region, and setting a region where half value width is increased by more than the range of permissible error (i.e., approximately 20% or more) compared to a point sufficiently distant from the thermal strain application region as the plastic strain region enables quantifying the plastic strain region.

Figure 3:
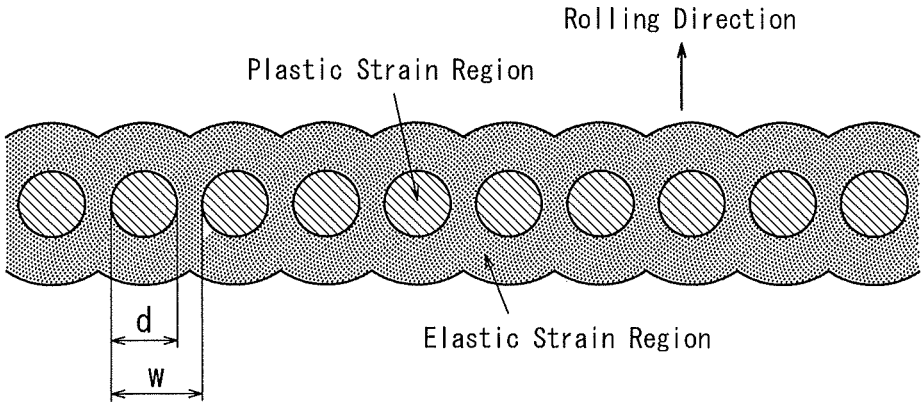
FIG. 3 is a schematic diagram illustrating an example of plastic strain regions and an elastic strain region.
Figure 4:
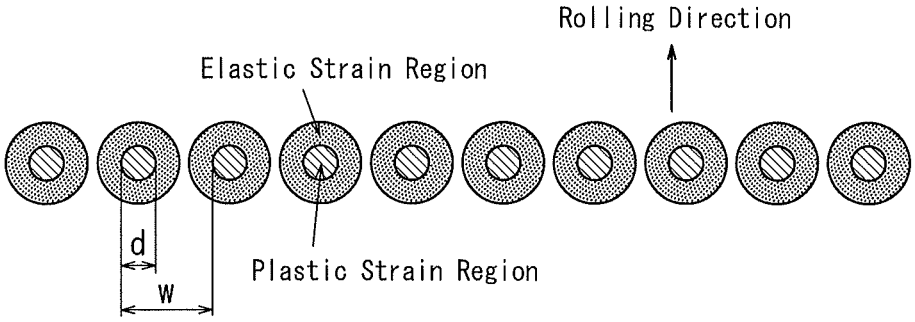
FIG. 4 is a schematic diagram illustrating another example of plastic strain regions and elastic strain regions.

From the results of our tests to examine characteristics of a transformer manufactured from a grain-oriented electrical steel sheet having various types of strain distribution, we identified that both iron loss reduction and noise suppression can be achieved when the plastic strain region is in an intermittent distribution as shown in FIGS. 3 and 4 with the ratio d/w of the size of length d of the plastic strain region illustrated in the figures and application interval w of plastic strain region illustrated in the figures being in a particular range. Further, when thermal strain was applied in a pulse, the form of FIG. 2 where the plastic strain region was continuously applied exhibited a poor noise suppressing effect.

In addition, we also identified that, even when the resultant steel sheets have equal strain distributions, lower iron loss can be obtained by electron beam irradiation compared to laser irradiation.

Length d of each of the above plastic strain region is 0.05 mm or more to 0.4 mm or less. This is because if the length d is shorter than 0.05 mm, a sufficient magnetic domain refinement effect cannot be obtained and iron loss reduction effect is small, whereas if the length d is longer than 0.4 mm, an increase in hysteresis loss, or an increase in noise generated in a transformer is caused.

Further, as described previously, it is important that the plastic strain region is applied in an intermittent distribution. The presence ratio can be obtained by a ratio ($\Sigma d/\Sigma w$) when setting a total of the application interval w of each of the plastic strain regions per one thermal strain application line as $\Sigma w$, and a total of the length d of each of the plastic strain regions per one thermal strain application line as $\Sigma d$. It is crucial to set the value to 0.2 or more and 0.6 or less. When expressed in percentage, the value is 20% or more and 60% or less.

The reason for the limitation of the above presence ratio is that, if the percentage of ($\Sigma d/\Sigma w$) is smaller than 20%, magnetic domain refinement effect cannot be obtained and iron loss reduction effect is small, whereas if the above percentage is larger than 60%, the noise generated in a transformer increases. From the perspective of noise suppression, the preferable range of the above percentage is 40% or less.

Further, the ratio d/w of each of the above lengths to each of the above application intervals is preferably 0.2 or more and 0.6 or less. This is because if the ratio of each length to each application interval individually satisfies the above range, an even more uniform magnetic domain refining would be applied to the steel sheet compared to the aforementioned case using the ratio between the total values $\Sigma d$ and $\Sigma w$. Further, in a general equipment for laser irradiation or electron beam irradiation, once the application interval w of a plastic strain region and the length d corresponding to the application interval w of the plastic strain region at one location in a thermal strain application line (see FIGS. 3 and 4) are measured, the strain application line, and the strain application regions (lines) which are further repeatedly formed can be evaluated as having an equal effect.

While the reason why noise generated in a transformer can be reduced by controlling the form of the region where plastic strain is generated is not clear, we believe that it is as follows.

The above problem is that when the length d is longer than 0.4 mm or when the above ratio ($\Sigma d/\Sigma w$) is larger than 0.6, the increase in noise becomes pronounced when worked into a transformer, although there is no significant degradation in magnetic characteristics as a single sheet.

When considering the difference between a single sheet and an iron core of a transformer, the difference lies in the fact that steel sheets are stacked and bound in the iron core. In particular, the fastening force for binding is large in a condition that causes degradation in noise of the transformer. According to this fact, when the plastic strain region is excessive, a pronounced deflection in the widthwise direction of the steel sheet occurs and, when the deflection is corrected at the time the steel sheet being bound and fixed as an iron core of the transformer, an internal stress is generated in the steel sheet, thereby causing generation of fine magnetic domain as well as an increase in magnetostriction. We believe that this mechanism causes a pronounced increase in noise.

Even when a plastic strain region with the same size is formed on the surface of the steel sheet, it would be possible to reduce more iron loss of a transformer by electron beam irradiation than by laser irradiation.

We believe that this is because while a laser which is a light heats only the surface of the steel sheet, an electron beam enters the steel sheet to heat it and forms a plastic strain region and a elastic strain region in a deeper region compared to a laser.

Our grain-oriented electrical steel sheet is preferably a steel sheet that has a texture with an easy magnetization axis in rolling direction (L direction) and constituted with crystal grains with (110)[001] orientation to reduce iron loss. However, an easy magnetization axis of a grain-oriented electrical steel sheet that can actually be industrially manufactured is not completely parallel to rolling direction, but has a deviation angle with respect to rolling direction. Further, to reduce iron loss by magnetic domain refining of the grain-oriented electrical steel sheet, we believe that it is effective to form a strain region or strain regions made from tensile residual stress and plastic strain on the surface of the steel sheet continuously or at a predetermined interval, in the magnetization direction, i.e., in the orthogonal direction to the easy magnetization axis.

With respect to a grain-oriented electrical steel sheet subjected to magnetic domain refining treatment, it is known that higher orientation integration of secondary recrystallization results in smaller magnetic domains. $B_8$ (flux density of when magnetized at 800 A/m) is frequently used as an indication of orientation integration. $B_8$ of the grain-oriented electrical steel sheet used herein is preferably 1.88 T or more and more preferably 1.92 T or more.

Further, it is preferable for the surface of the electrical steel sheet to be subjected to tension coating. Although any conventionally known tension coating may be applied, it is preferable that the glass tension coating contains phosphate and silica as the primary components such as aluminum phosphate or magnesium phosphate.

The above described thermal strain application line is preferably linearly formed in the widthwise direction of the steel sheet (direction orthogonal to the rolling direction), and it is preferably repeatedly formed in the rolling direction with an interval of 2 mm or more and 10 mm or less. This is because an increase in iron loss and an increase in transformer noise easily occur with an interval smaller than 2 mm, and the iron loss reduction effect obtained by magnetic domain refining is poor with an interval larger than 10 mm.

In the case of laser irradiation, a laser oscillator that oscillates Q switch pulses or normal pulses may be used as an apparatus for applying plastic strain. Further, switching of continuous oscillation, and intermittent irradiation using a chopper is also possible. In the case of electron beam irradiation, an intermittent plastic strain region can be formed by, switching the beam current on and off, continuously moving the laser while adjusting intensity, repeating movement/stop or high speed movement/low speed movement of the continuously generating electron beam to perform scanning in widthwise direction.

The chemical composition of a slab for a grain-oriented electrical steel sheet is not particularly limited and any chemical composition that allows secondary recrystallization to proceed may be used.

Further, the chemical composition may contain appropriate amounts of Al and N when an inhibitor, e.g., an AlN-based inhibitor, is used or appropriate amounts of Mn and Se and/or S in the case where an MnS.MnSe-based inhibitor is used. Of course, these inhibitors may also be used in combination. In this case, preferred contents of Al, N, S and Se are: Al: 0.01 mass % to 0.065 mass %; N: 0.005 mass % to 0.012 mass %; S: 0.005 mass % to 0.03 mass %; and Se: 0.005 mass % to 0.03 mass %, respectively.

Furthermore, our methods are also applicable to a grain-oriented electrical steel sheet having limited contents of Al, N, S and Se without using an inhibitor.

In this case, the contents of Al, N, S and Se are preferably limited to Al: 100 mass ppm or less, N: 50 mass ppm or less, S: 50 mass ppm or less, and Se: 50 mass ppm or less, respectively.

Additionally, specific basic components and optionally added components of a slab for the grain-oriented electrical steel sheet are as follows.

C: 0.08 mass % or less

C is added to improve the texture of a hot-rolled sheet. However, if the C content exceeds 0.08 mass %, it becomes difficult to reduce the C content to 50 mass ppm or less, at which point magnetic aging will not occur during the manufacturing process. Therefore, the C content is preferably 0.08 mass % or less. Besides, it is not necessary to set a particular lower limit to the C content because secondary recrystallization is enabled by a material not containing C.

Si: 2.0 mass % to 8.0 mass %

Si is an element effective in enhancing electrical resistance of steel and improving iron loss properties thereof. However, if the content is less than 2.0 mass %, a sufficient iron loss reduction effect cannot be achieved. On the other hand, Si content above 8.0 mass % significantly deteriorates formability and also decreases the flux density of the steel. Therefore, the Si content is preferably 2.0 mass % to 8.0 mass %.

Mn: 0.005 mass % to 1.0 mass %

Mn is a necessary element to achieve better hot workability of steel. However, this effect is poor when the Mn content in steel is below 0.005 mass %. On the other hand, Mn content in steel exceeding 1.0 mass % deteriorates magnetic flux of a product steel sheet. Therefore, the Mn content is preferably 0.005 mass % to 1.0 mass %.

Furthermore, in addition to the above basic components, the slab may also contain the following as elements to improve magnetic properties as deemed appropriate:

At least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, and Mo: 0.005 mass % to 0.10 mass %.

Ni is an element useful to improve the texture of a hot rolled steel sheet for better magnetic properties thereof. However, Ni content in steel below 0.03 mass % is less effective for improving magnetic properties, while Ni content in steel above 1.50 mass % makes secondary recrystallization of the steel unstable, thereby deteriorating the magnetic properties thereof. Therefore, Ni content is preferably 0.03 mass % to 1.50 mass %.

In addition, Sn, Sb, Cu, P, Cr, and Mo are each useful elements in terms of improving magnetic properties of steel. However, each of these elements becomes less effective in improving magnetic properties of the steel when contained in steel in an amount less than the aforementioned lower limit and inhibits the growth of secondary recrystallized grains of the steel when contained in steel in an amount exceeding the aforementioned upper limit. Therefore, each of these elements is preferably contained within the respective ranges thereof specified above.

The balance other than the above-described elements is Fe and incidental impurities that are incorporated during the manufacturing process.

Next, the slab having the above described chemical composition is subjected to heating before hot rolling in a conventional manner. However, the slab may also be subjected to hot rolling directly after casting, without being subjected to heating. In the case of a thin slab or thinner cast steel, it may be subjected to hot rolling or directly proceed to the subsequent step, omitting hot rolling.

Furthermore, the hot rolled sheet is optionally subjected to hot band annealing. At this time, to obtain a highly-developed Goss texture in a product sheet, hot band annealing temperature is preferably 800° C. to 1100° C. If the hot band annealing temperature is lower than 800° C., there remains a band texture resulting from hot rolling, which makes it difficult to obtain a primary recrystallization texture of uniformly sized grains and impedes the growth of secondary recrystallization. On the other hand, if the hot band annealing temperature exceeds 1100° C., the grain size after the hot band annealing coarsens too much, which makes it extremely difficult to obtain a primary recrystallization texture of uniformly-sized grains.

After the hot band annealing, the sheet is subjected to cold rolling once, or twice or more with intermediate annealing performed therebetween, followed by recrystallization annealing and application of an annealing separator to the sheet. After the application of the annealing separator, the sheet is subjected to final annealing for purposes of secondary recrystallization and formation of a forsterite film.

After the final annealing, it is effective to subject the steel sheet to flattening annealing to correct the shape thereof. In the case of stacking steel sheets for use, it is effective to apply tension coating to the surface of the steel sheets before or after the flattening annealing, for the purpose of improving iron loss properties.

Other than the above-described steps and manufacturing conditions, a conventionally known method of manufacturing a grain-oriented electrical steel sheet may be used as appropriate.

Further, it is also possible to use a grain-oriented electrical steel sheet to which a technique of reducing hysteresis loss by smoothening the steel sheet surface without forming a forsterite film thereon, is applied.

EXAMPLES

Example 1

A coil of a grain-oriented electrical steel sheet having a sheet thickness of 0.23 mm and flux density $B_8$ in rolling direction of 1.94 T, and having 2 layers of coating, namely a coating containing forsterite as the primary component and a coating (silica/phosphate based coating) formed by baking a coating solution of inorganic substance thereon, on the surface of the steel substrate, was prepared.

First, a single sheet sample with a width of 100 mm and a length of 400 mm was cut out from the coil and subjected to magnetic domain refining treatment by irradiating a Q-switched pulse oscillation fiber laser. The beam diameter of the laser was changed in the range of 0.05 to 0.6 mm by defocusing, and the repeating interval in widthwise direction was set to 0.1 to 1.2 mm, to search for the power which most reduces iron loss.

The width of the plastic strain region was enlarged by enlarging the beam diameter and increasing the beam power so that sufficient thermal strain is applied in accordance with the increase of area. Further, by increasing and decreasing the holding time of beam irradiation at one location, the size of the elastic strain region was controlled.

Further, the repeating interval in rolling direction of the strain regions was set to 4.5 mm.

The distribution in widthwise direction of the plastic strain region in the strain region was obtained by measuring the half value width of the diffraction peak of the α-fe {112} plane by X-ray diffraction using a Cr—Kα X-ray. The region where the half value width is increased by 20% or more compared to the position located 2 mm away in rolling direction from the beam irradiation position, was defined as the plastic strain region.

Next, laser irradiation was performed on the overall width of the coil with the optimum beam power obtained in the above study to manufacture the coil for iron core material. Further, this coil was used as an iron core material to prepare a transformer. The iron core is an iron core of stacked three-phase tripod type with a leg width of 150 mm and weight of 900 kg. The transformer is an oil immersed transformer with a capacity of 1000 kVA.

Figure 5:
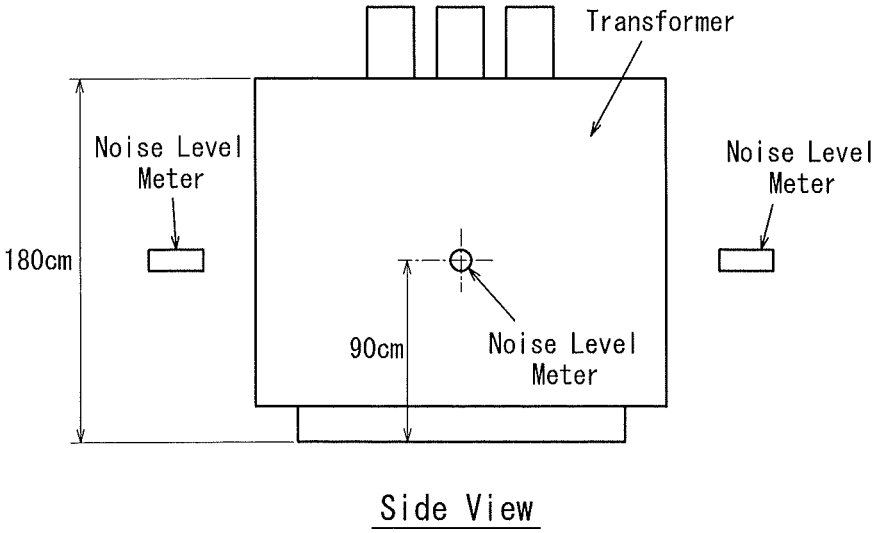
FIG. 5 illustrates the procedures of measuring noise of a transformer.

Flux density of the iron core was exited to 1.7 T at 50 Hz, and no-load loss was measured and defined as the value of iron loss. Further, as illustrated in FIG. 5, noise was measured 30 cm from the outer surface of the transformer in front, back, left and right of it to obtain the average value.

TABLE 1

| No. | Length d of Plastic Strain Region (mm) | Introduction Interval w of Plastic Strain Region (mm) | Ratio of d to w d/w × 100 (%) | Iron Loss of Transformer (W) | Noise of Transformer (dB) | Remarks |
|---|---|---|---|---|---|---|
| 1 | 0.05 | 0.15 | 33 | 787 | 52 | Example |
| 2 | 0.2 | 0.34 | 59 | 777 | 53 | Example |
| 3 | 0.2 | 0.5 | 40 | 778 | 52 | Example |
| 4 | 0.2 | 1.0 | 20 | 788 | 52 | Example |
| 5 | 0.4 | 0.7 | 57 | 788 | 52 | Example |
| 6 | 0.04 | 0.08 | 50 | 834 | 57 | Comparative Example |
| 7 | 0.2 | 0.32 | 63 | 799 | 56 | Comparative Example |
| 8 | 0.2 | 1.2 | 17 | 844 | 53 | Comparative Example |
| 9 | 0.5 | 0.85 | 59 | 833 | 56 | Comparative Example |

As shown in Table 1, excellent characteristics with iron loss of 630 W or less and transformer noise of 53 dB or less, were obtained in a condition within our range.

Example 2

Magnetic domain refining was performed by irradiating electron beam to a coil of the same grain-oriented electrical steel sheet as Example 1.

Electron beam irradiation was performed with an acceleration voltage of 60 kV and beam diameter of 0.25 mm. Irradiation was stopped at one location for 10 ms, and then moved to the next irradiation point with the repeating interval set to 0.34 mm and 0.5 mm. Other conditions of the irradiation were as described in Table 2. Further, a condition where the width of the plastic strain region is 0.2 mm and the iron loss is minimized was searched. An iron core of a transformer was manufactured using the condition, in the same manner as Example 1, and iron loss and noise were tested.

TABLE 2

| No. | Method of Magnetic Domain Refining Treatment | Length d of Plastic Strain Region (mm) | Application Interval w of Plastic Strain Region (mm) | Ratio of d to w d/w × 100 (%) | Iron Loss of Transformer (W) | Noise of Transformer (dB) | Remarks |
|---|---|---|---|---|---|---|---|
| 1 | Electron Beam | 0.2 | 0.34 | 59 | 754 | 53 | Example |
| 2 | Electron Beam | 0.2 | 0.50 | 40 | 755 | 52 | Example |
| 3 | Laser | 0.2 | 0.34 | 59 | 777 | 53 | Example |
| 4 | Laser | 0.2 | 0.50 | 40 | 778 | 52 | Example |

When comparing with laser irradiation of Example 1, iron loss value was smaller by 22 W or more in coils irradiated with electron beam, as shown in Table 2.

The invention claimed is:

1. A grain-oriented electrical steel sheet having plastic strain regions in a dot-sequence manner in a widthwise direction of the steel sheet with magnetic domain refining treatment, wherein a length d of each of the plastic strain regions in the widthwise direction of the steel sheet is 0.05 mm or more and 0.4 mm or less, an application interval w of each of the plastic strain regions is 0.15 mm to 1.0 mm, a ratio $\Sigma d/\Sigma w$ of a total $\Sigma d$ of the length d to a total $\Sigma w$ of the application interval w of each of the plastic strain regions is 0.2 or more and 0.6 or less, and the grain-oriented electrical steel sheet has a composition comprising C: 0.08 mass % or less, Si: 2.0 mass % to 8.0 mass %, Mn: 0.005 mass % to 1.0 mass % and a balance of Fe and incidental impurities.

2. The grain-oriented electrical steel sheet according to claim 1, wherein a ratio d/w of the length d of each of the plastic strain regions to the application interval w corresponding to the length d of each of the plastic strain regions is 0.2 or more and 0.6 or less.

3. The grain-oriented electrical steel sheet according to claim 1, wherein the plastic strain regions are formed by electron beam irradiation.

4. The grain-oriented electrical steel sheet according to claim 2, wherein the plastic strain regions are formed by electron beam irradiation.

* * * * *